US006402554B1

(12) United States Patent
Yeh

(10) Patent No.: US 6,402,554 B1
(45) Date of Patent: Jun. 11, 2002

(54) VERTICAL SMT-TYPE ELECTRICAL CONNECTOR

(75) Inventor: Joel Jyhhaur Yeh, Diamond Bar, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/785,897

(22) Filed: Feb. 16, 2001

(51) Int. Cl.[7] ..... H01R 13/648
(52) U.S. Cl. ..... 439/607
(58) Field of Search ..... 439/607–610, 439/83, 636, 630

(56) References Cited

U.S. PATENT DOCUMENTS 5,941,725 A * 8/1999 Brennan et al. ..... 439/607
6,007,381 A * 12/1999 Ando et al. ..... 439/607
6,059,581 A * 5/2000 Wu ..... 439/607
6,077,118 A * 6/2000 Harada et al. ..... 439/607
6,203,373 B1 * 3/2001 Lin ..... 439/607

* cited by examiner

*Primary Examiner*—Gary Paumen
(74) *Attorney, Agent, or Firm*—Wei Te Chung

(57) ABSTRACT

An electrical connector (1) adapted to be vertically mounted to a circuit board includes an insulative housing (2), a number of L-shaped conductive contacts (4) therein and a shield (3) substantially enclosing the housing. The housing includes an elongate body (20) and an upper projection (26) extending upwardly from a top surface (21) of the body. The shield includes a front shell (5) and a rear shell (6). The front shell includes a front panel (51), two side panels (52) extending from opposite edges of the front pane, and an upper extension (54) offsetting from the front panel. Therear shell (6) includes a rear panel (61), two upper side panels (62) extending from the rear panel and a lower extension (67) offsetting from the rear panel.

1 Claim, 5 Drawing Sheets

VERTICAL SMT-TYPE ELECTRICAL CONNECTOR

FIELD OF THE INVENTION

The present invention generally relates to an electrical connector for mobile phone, and in particular to a vertical SMT-type electrical connector for a mobile phone charging station.

BACKGROUND OF THE INVENTION

Connectors are commonly used in mobile phones for providing releasable electrical connection between mobile phones and external devices, such as a battery charger or a mobile cradle.

Such a conventional connector is disclosed in U.S. Pat. No. 6,077,118. In this prior art patent, a connector includes an insulative housing and a plurality of terminals mounted in the housing. A metal shell is disposed about the outer periphery of the housing. Each terminal includes a contact portion for engaging with a counterpart terminal of a mating connector, a retaining portion downwardly extending from the contact portion and a tail portion. The tail portion extends from the retaining portion and is parallel to the contact portion for soldering to a circuit board. A pair of positioning posts are formed integrally with the shell and project downwardly for inserting into appropriate mounting holes in the circuit board for preventing the connector from moving. The connector is horizontally surface mounted on the circuit board.

However, the connector is unfit to electrically and mechanically connect an external device which is mounted normal to the circuit board. Furthermore, due to the connector is horizontally surface mounted on the circuit board, the connector occupies so large place of the circuit board. Furthermore, the contact portion of each terminal bears against a corresponding counterpart terminal of the mating connector with a large normal force. Thus, the tail portion of each terminal bears against the contact portion with a large force because the tail portion is parallel to the contact portion. Therefore, the connection between the tail portion and the circuit board tends or become damaged after a period of use, resulting in an unreliable connection. Furthermore, in order to preventing the connector from reciprocating moving, the shell of the connector forms positioning posts to complicate the processing of manufacturing.

The present invention aims to solve the problem by providing a vertical SMT-type connector for a mobile phone connection system.

SUMMARY OF THE INVENTION

Accordingly, an object of the present invention is to provide a vertical SMT-type electrical connector for a mobile phone connection system.

Another object of the present invention is to provide an electrical connector of which the terminals effectively engage with a circuit board.

To achieve the above objects, an electrical connector in accordance with the present invention comprises an insulative housing, a plurality of L-shaped conductive contacts retained in the housing and a shield substantially enclosing the housing. The housing includes an elongate body and an upper projection extending upwardly from a top surface of the body. Each contact includes an engaging section and a tail section perpendicularly to each other. The shield includes a front shell and a rear shell. The front shell includes a front panel for shielding a front surface of the body of the housing, two side panels for abutting against side surfaces of the housing and an upper extension for shielding a front surface of the upper projection of the housing. The side panels extend from opposite edges of the front panel. The upper extension offsets from the front panel. The rear shell includes a rear panel for shielding a rear surface of the body of the housing, two upper side panels for abutting against side surfaces of the housing and a lower extension for shielding a rear surface of the upper of the housing. The upper side panels extend from the rear panel. The lower extension offsets from the rear panel.

The connector mounted on the circuit board occupies a small space. When a tongue plate of a mating connector engages with the connector, the contacts of the mating connector electrically engage with corresponding contacts to establish a desired electrical connection between the connector and the mating connector. At the same time, the engaging section of each contact bears against a corresponding counterpart contact of the mating connector with a force in a direction along the engaging section. The tail portion bears against the engaging section with little force because the tail portion is perpendicular to the engaging section whereby the movement of the tail section with respect to the circuit board is avoided. Therefore, reliable connection between the connector and the circuit board is maintained.

Other objects, advantages and novel features of the invention will become more apparent from the following detailed description when taken in conjunction with the accompanying drawings.

DETAILED DESCRIPTION OF THE INVENTION

Figure 1:
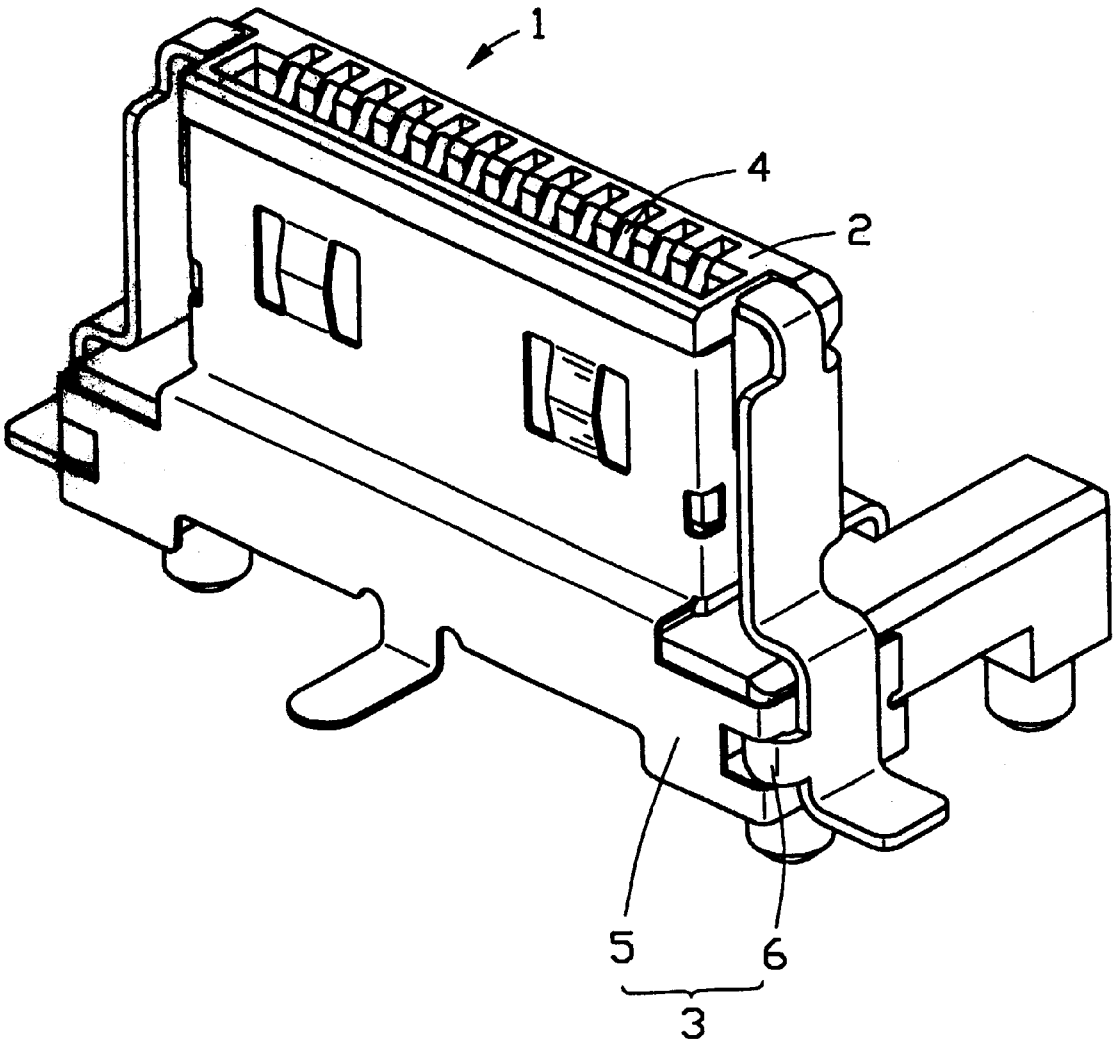
FIG. 1 is a perspective view of a vertical SMT-type connector in accordance with the present invention.
Figure 2:
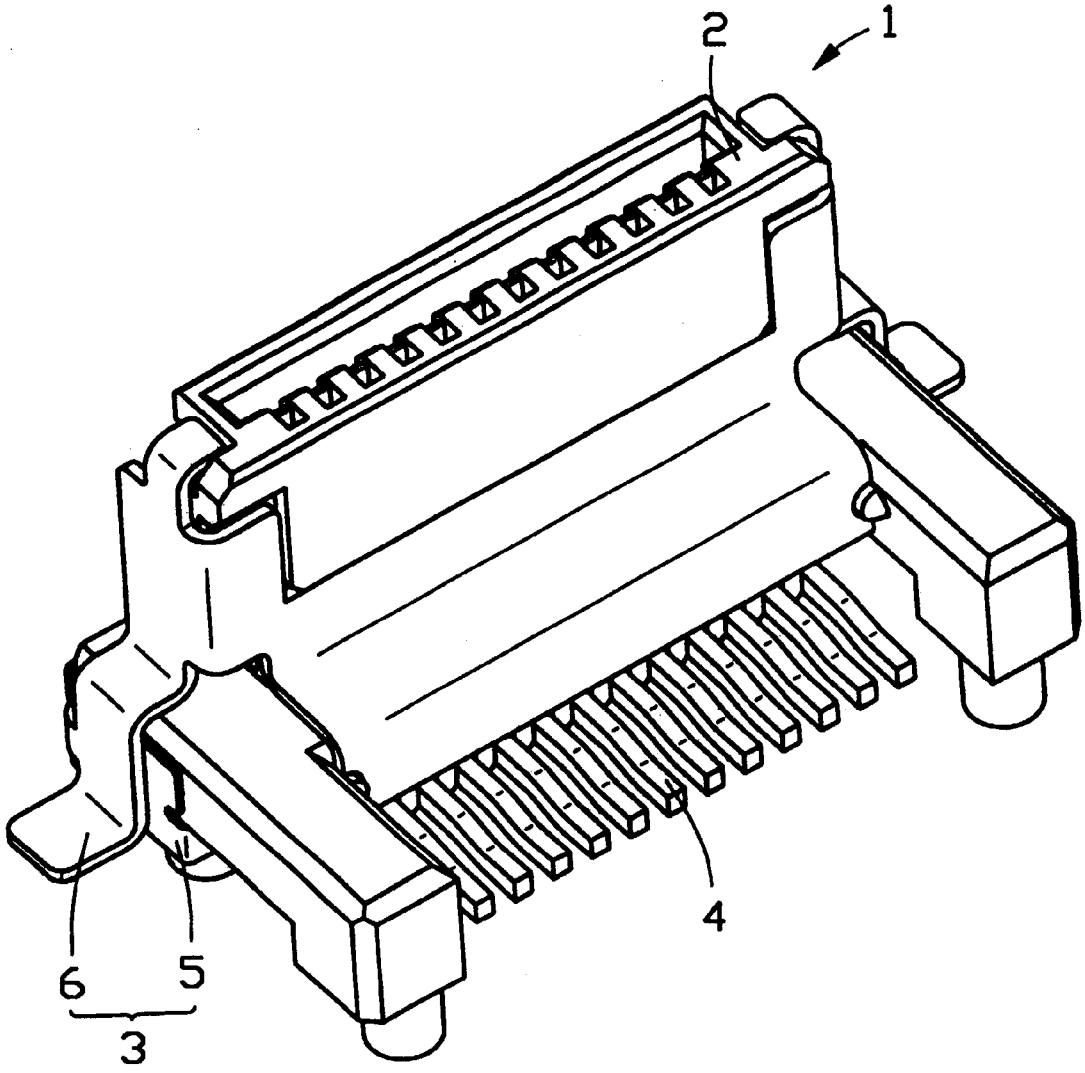
FIG. 2 is a view similar to FIG. 1 but taken from another perspective.

Referring to the drawings and in particular to FIGS. 1 and 2, an vertical SMT-type connector 1 according to the present invention comprises an insulative housing 2, a plurality of conductive contacts 4 retained in the housing 2 and a shield 3 substantially enclosing the housing 2.

Figure 3:
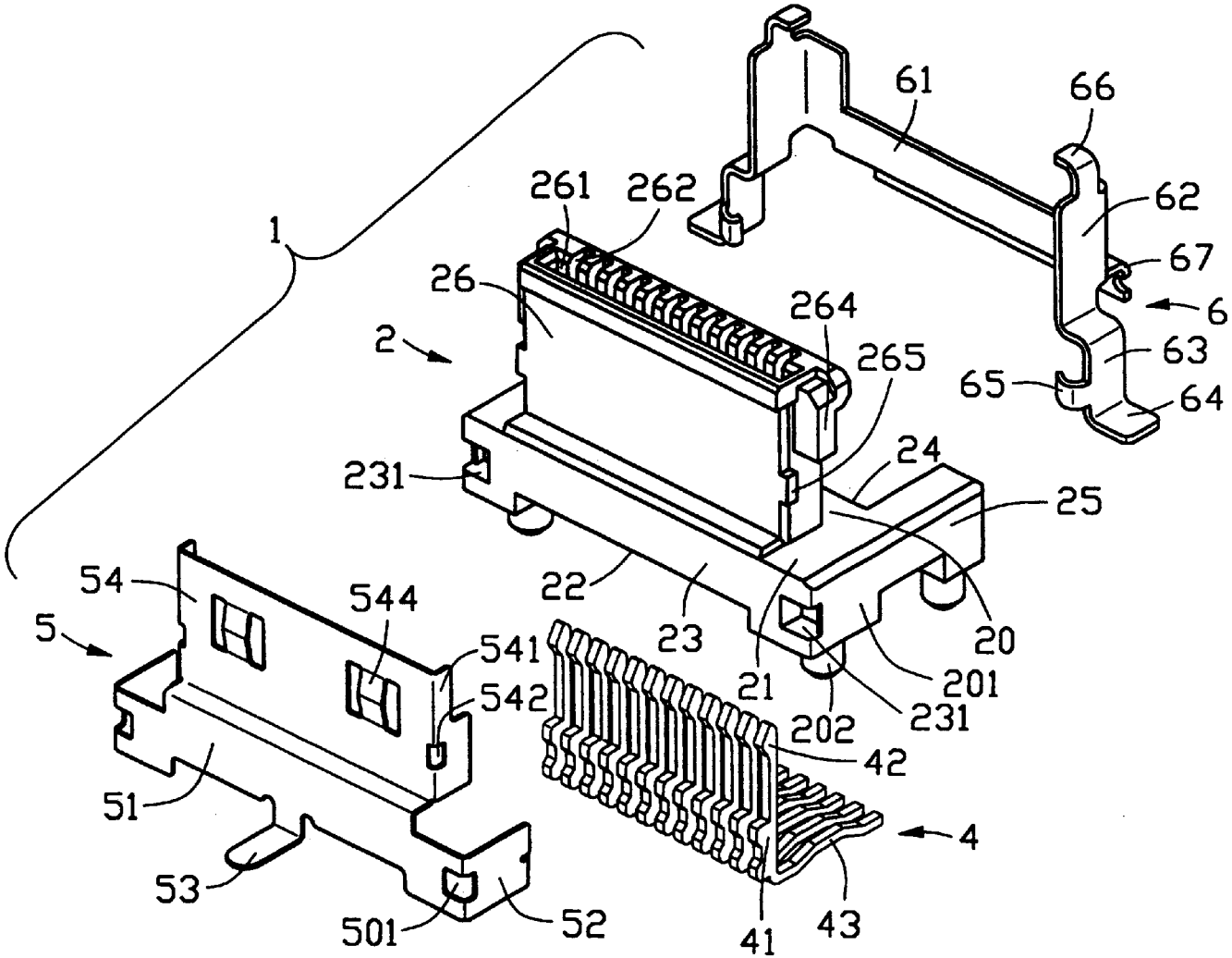
FIG. 3 is an exploded view of FIG. 1.
Figure 4:
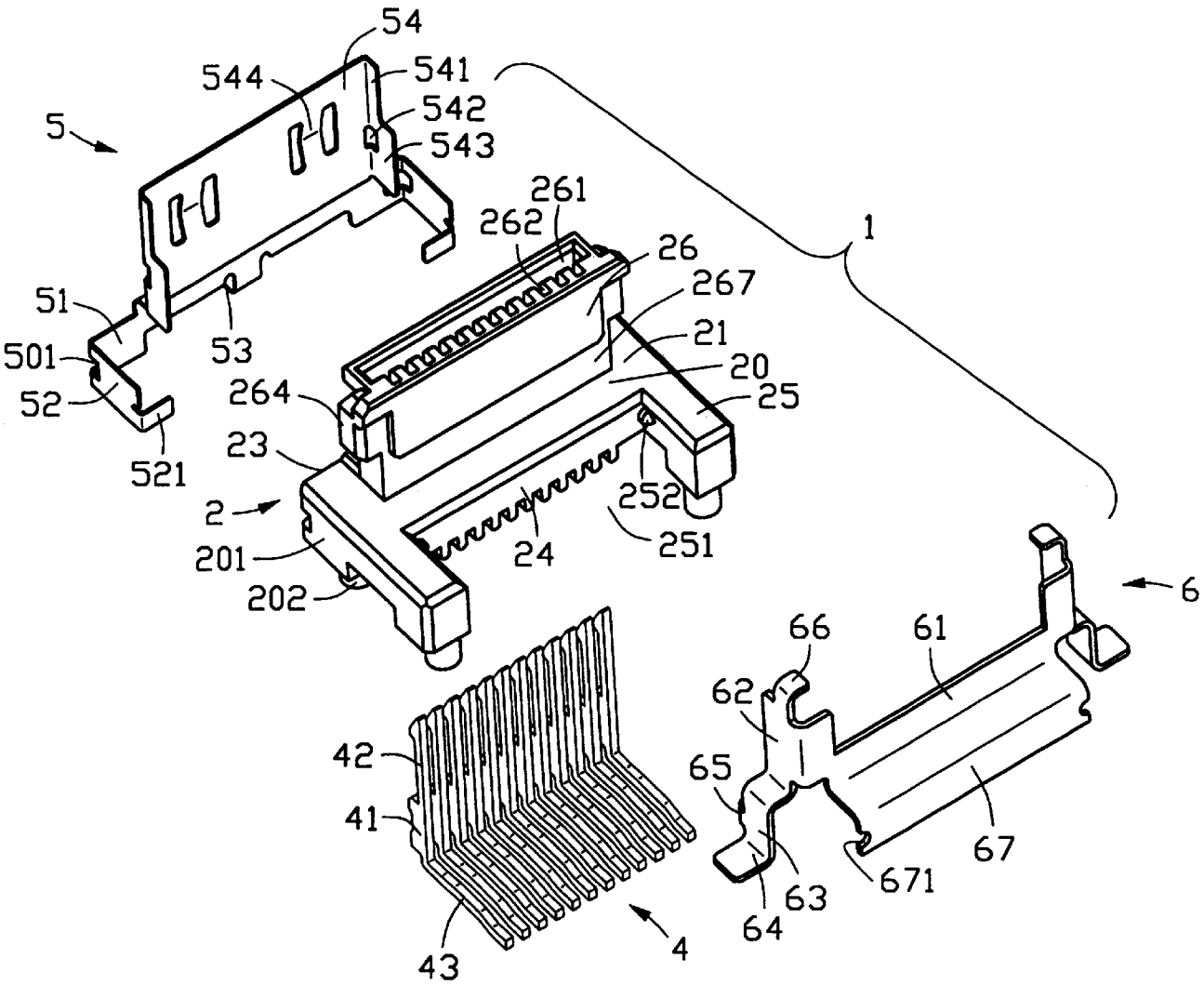
FIG. 4 is a view similar to FIG. 3 but taken from a different perspective.
Figure 5:
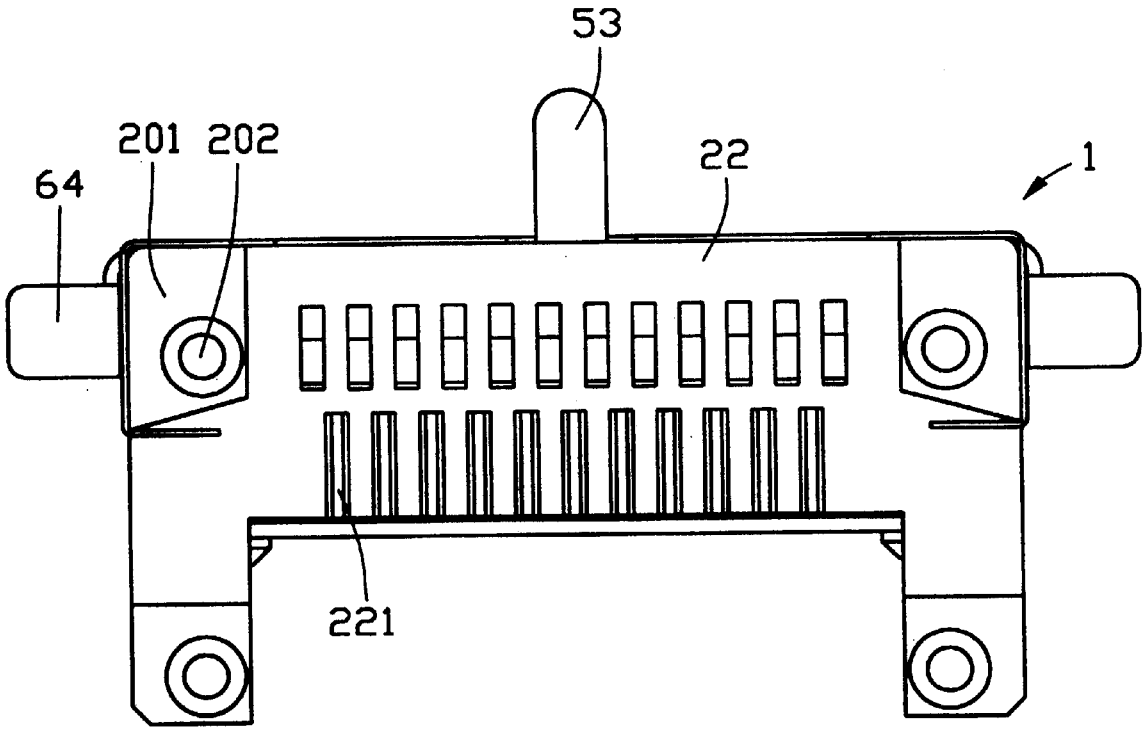
FIG. 5 is a bottom plan view of FIG. 1, wherein conductive contacts of the connector are removed for clarity.

Further referring to FIGS. 3, 4 and 5, the housing 2 comprises an elongate body 20 and an upper projection 26. The body 20 has a top surface 21, an opposite bottom surface 22, a front surface 23 and an opposite rear surface 24. A plurality of elongate protrusions 221 (see FIG. 5) are formed on the bottom surface 22 for spacedly dividing and securely retaining conductive contacts 4. The body 20 forms two elongate side projections 25 on opposite sides thereof in a front-to-rear direction. A pair of bumps 252 are rearwardly formed on opposite ends of the rear surface 24 and attach to inward surfaces (not labeled) of the side projections 25. A rear space 251 is defined between the side projections 25. Each side projection 25 downwardly forms two stand-offs 201 on respective bottom surface thereof. A cutout 231 is defined in a corresponding front comer of the body 20 opposite the side projection 25. Each stand-off 201 downwardly forms a post 202 for properly positioning the housing 2 on a circuit board (not shown). The upper projection 26 extends upwardly from the top surface 21. A receiving slot or mating opening 261 is defined in the upper projection 26 for receiving a tongue plate of a mating connector (not shown). A plurality of contact receiving channels 262 are defined in a rear side of the receiving slot 261 and extend through the body 20 and the elongate protrusion 221 for receiving and retaining conductive contacts 4 therein. The upper projection 26 forms side blocks 264 on opposite sides thereof. A pair of barbs 265 are respectively formed on opposite sides of the upper projection 26 proximate the side blocks 264. A recess 267 is defined in a rearward lower portion of the upper projection 26 for accommodating part of the rear shell 6.

Each contact 4 is L-shaped and has a retaining section 41 for being retained in the channel 262 of the body 20. An engaging section 42 upwardly extends from the retaining section 41. A tail section 43 rearwardly extends from a bottom of the retaining section 41. The engaging section 42 extends through the corresponding contact receiving channel 262 for electrically engaging with counterpart contacts of the mating connector. The tail section 43 is received in a groove (not labeled) defined between two adjacent protrusions 221 and rearwardly extends out of the body 20 for soldering to the circuit board, for example via surface mount techniques (SMT).

The shield 3 has a front shell 5 and a rear shell 6. The front shell 5 comprises a front panel 51 positioned on the front surface 23 of the body 20 of the housing 2, and two side panels 52 extending from opposite edges of the front panel 51. The side panels 52 abut against side surfaces (not labeled) of the side projection 25 and side surfaces (not labeled) of corresponding stand-off 201. Two substantially rectangular openings 501 are respectively defined in comers between the front panel 51 and the side panel 52. A patch 521 inwardly extends from each rear edge of the side panels 52 and is parallel to the front panel 51 for abutting against a rear surface (not labeled) of the side projection 25 or of the corresponding stand-off 201 as shown. A front solder tab 53 extends horizontally from substantially a middle of a lower edge of the front panel 51 for surface mounting on the circuit board, such as for grounding purpose.

An upper extension 54 upwardly extends and offsets from the front panel 51 and is attached to a front surface of the upper projection 26 of the housing 2. Two side flanges 541 extend from opposite edges of the upper extension 54 for abutting against sides of the upper projection 26. A substantially rectangular aperture 542 is defined in a corner between the upper extension 54 and each side flange 541 for engaging with the corresponding barbs 265 of the upper projection 26, thereby securing the front shell 5 to the housing 2. Resilient grounding tabs 544 forwardly protrude on the upper extension 54 for electrically engaging with a grounding member of the mating connector for grounding and electrostatic discharge purposes.

The rear shell 6 comprises a rear panel 61 accommodated by the recess 267 of the upper projection 26, and two upper side panels 62 extending from opposite edges of the rear panel 61 for abutting against side surfaces of the side blocks 264 of the upper projection 26. A free end 66 extends upwardly from an upper edge of each upper side panel 62 and inwardly bends for engaging the corresponding side block 264 of the upper projection 26, thereby securing the rear shell 6 to the housing 2. Two lower side panels 63 respectively outwardly offset from corresponding upper side panels 62 for overlapping the side panel 52 of the front shell 5. A side solder tab 64 outwardly and horizontally extends from each lower edge of the lower side panels 63. Each lower side panel 63 forms an arcuate tab 65 on a front edge thereof. The arcuate tab 65 extends through the opening 501 of the front shell 5 and engages with the cutout 231. A lower extension 67 downwardly extends and offsets from the rear panel 61 and overlies the rear surface 24 of the body 20. A pair of indentations 671 are defined on opposite sides of the lower extension 67 for engaging with corresponding bumps 252.

The connector 1 mounted on the circuit board occupies a small space. When the tongue plate of the mating connector is inserted into the receiving slot 261 of the connector 1, the contacts of the mating connector electrically engage with corresponding contacts 4 to establish a desired electrical connection between the connector 1 and the mating connector. At the same time, the engaging section 42 of each contact 4 bears against a corresponding counterpart contact of the mating connector with a force in a direction along the engaging section 42. The tail portion 43 bears against the engaging section 42 with little force because the tail portion 43 is perpendicular to the engaging section 42 whereby the movement of the tail section 43 with respect to the circuit board is avoided. Therefore, reliable connection between the connector 1 and the circuit board is maintained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A vertical SMT-type electrical connector mounted on a circuit board, comprising:

an insulative housing comprising an elongate body and an upper projection extending upwardly from a top surface of the body;

a plurality of L-shaped conductive contacts retained in the housing; and a shield substantially enclosing the housing and shielding the contacts, comprising:

a front metal shell including a front panel for shielding a front surface of the body of the housing, two side panels extending from opposite edges of the front panel for abutting against side surfaces of the housing, and an upper extension offsetting from the front panel for shielding a front surface of the upper projection of the housing; and a rear shell including a rear panel for shielding a rear surface of the body of the housing, two upper side panels extending from the rear panel for abutting against side surfaces of the housing, and a lower extension offsetting from the rear panel for shielding a rear surface of the upper projection of the housing;

wherein the housing comprises at least one cutout, the front shell defines at least one opening, and the rear shell forms at least one arcuate tab extending through the at least one opening to engage with the at least one cutout;

wherein two elongate side projections are formed on opposite sides of the body;

wherein at least one stand-off downwardly depends from a bottom surface of the housing, and wherein at least one patch extends from an edge of the side panel for abutting against the at least one stand-off, thereby fixing the front shell to the housing;

wherein two side flanges extend from opposite edges of the upper extension for abutting against opposite sides of the upper projection;

wherein at least one aperture is defined in the upper extension of the front shell, and wherein at least one barb is formed on the upper projection of the housing for engaging with the at least one aperture for accommodating a part of the front shell to the housing;

wherein at least one front solder tab horizontally extends from the front shell for surface mounting on the circuit board;

wherein a recess is defined in a rear surface of the housing for accommodating a part of the rear shell;

wherein the upper projection of the housing forms two side blocks on opposite sides thereof, and wherein a free end is inwardly bent from each upper side panel of the rear panel for engaging with a corresponding side block of the upper projection;

wherein a lower side panel is offset from each upper side panel for overlapping a corresponding side panel of the front shell;

wherein at least one side solder tab horizontally extends from a lower side panel for surface mounting on the circuit board;

wherein at least one indentation is defined in the lower extension of the rear shell, and wherein at least one bump is formed on the body of the housing for engaging with the at least one indentation for fixing the rear shell to the housing.

* * * * *